US008082930B2

(12) United States Patent
Hsu

(10) Patent No.: US 8,082,930 B2
(45) Date of Patent: Dec. 27, 2011

(54) HAIR CLIP WITH TINES EXTENDING PARALLEL TO THE ENVELOPED HAIR

(76) Inventor: Shih Ling Hsu, Tainan (TW)

( * ) Notice: Subject to any disclaimer, the term of this patent is extended or adjusted under 35 U.S.C. 154(b) by 202 days.

(21) Appl. No.: 12/492,795

(22) Filed: Jun. 26, 2009

(65) Prior Publication Data

US 2010/0326458 A1 Dec. 30, 2010

(51) Int. Cl.
*A45D 8/20* (2006.01)

(52) U.S. Cl. ..... 132/277; 132/279

(58) Field of Classification Search ..... 132/255, 132/273, 276, 277, 278, 279, 280, 281, 282, 132/283, 284; D28/40
See application file for complete search history.

(56) References Cited

U.S. PATENT DOCUMENTS

| | | | | | |
|---|---|---|---|---|---|
| 3,279,479 | A | * | 10/1966 | Solomon | 132/277 |
| 5,261,428 | A | * | 11/1993 | Wu | 132/281 |
| 5,533,533 | A | * | 7/1996 | Shing | 132/279 |
| 5,609,169 | A | * | 3/1997 | Yang | 132/279 |
| 5,638,836 | A | * | 6/1997 | Yasuda | 132/279 |
| 5,787,905 | A | * | 8/1998 | Yasuda | 132/277 |
| 5,842,485 | A | * | 12/1998 | Potut | 132/277 |
| 7,073,517 | B1 | * | 7/2006 | Burnette, III | 132/213.1 |
| D540,982 | S | * | 4/2007 | Vergona | D28/40 |
| D627,099 | S | * | 11/2010 | Tu | D28/40 |
| 2002/0129828 | A1 | * | 9/2002 | Ott | 132/148 |
| 2004/0065341 | A1 | * | 4/2004 | La Fauci | 132/277 |
| 2004/0182411 | A1 | * | 9/2004 | Rogers et al. | 132/277 |
| 2006/0096609 | A1 | * | 5/2006 | Nwokola | 132/201 |
| 2008/0156341 | A1 | * | 7/2008 | Longoria et al. | 132/277 |
| 2011/0005548 | A1 | * | 1/2011 | Goncalves Da Silva | 132/279 |
| 2011/0041867 | A1 | * | 2/2011 | Hsu | 132/276 |

FOREIGN PATENT DOCUMENTS

| | | | | |
|---|---|---|---|---|
| GB | 2326591 | A | * | 12/1998 |
| JP | 3161543 | U | * | 8/2010 |
| WO | WO-2009/086609 | | * | 6/2009 |

OTHER PUBLICATIONS

Translation of JP 3161543.*

* cited by examiner

*Primary Examiner* — Todd Manahan
*Assistant Examiner* — Tatiana Nobrega

(57) ABSTRACT

A hair ornament includes a body having an enveloping section for enveloping a portion of hair of a user. The enveloping section includes upper and lower ends spaced in a direction. The portion of the hair of the user extends through the upper and lower ends of the enveloping section. A styling section is mounted to the body. The styling section includes a plurality of tines extending in the direction. The tines of the styling section initially not extend through the hair of the user when the body is worn on the hair of the user. The body is movable relative to the hair of the user so that the tines of the styling section extend through another portion of the hair not enveloped by the enveloping section to position the body on the hair of the user.

1 Claim, 16 Drawing Sheets

A-A

B-B

C-C

HAIR CLIP WITH TINES EXTENDING PARALLEL TO THE ENVELOPED HAIR

BACKGROUND OF THE INVENTION

1. Field of the Invention

The present invention relates to a hair ornament and, more particularly, to a hair ornament providing a bulging effect of hair on a head of a user.

2. Description of the Related Art

A wide variety of hair ornaments has been developed to provide aesthetically pleasing effect on the hair of the wearer. FIGS. 15 and 16 show a conventional hair ornament including left and right clamping portions 1' and 2' each having a plurality of teeth 11' and 21' on a first side thereof and a pivotal portion 12', 22' on a second side thereof. A spring 3' is provided at the pivotal portions 12' and 22' so that an enveloping section 4' is formed between the clamping portions 1' and 2' under the action of the spring 3' with the hair of the user extending through upper and lower ends 41' and 42' of the enveloping section 4' when the hair ornament is worn on the head of the user. The enveloping section 4' holds a portion of the hair of the user to provide a tidy appearance. However, the hair ornament can not provide many hairstyles. As an example, the hair ornament can not provide a bulging effect at the rear or the front of the head of the user.

Thus, a need exists for a hair ornament capable of providing a bulging effect of hair on the head of the user.

BRIEF SUMMARY OF THE INVENTION

The present invention solves this need and other problems in the field of hair ornaments by providing, in a preferred form, a hair ornament including a body having an enveloping section adapted for enveloping a portion of hair of a user. The enveloping section includes upper and lower ends spaced in a direction. The portion of the hair of the user extends through the upper and lower ends of the enveloping section. A styling section is mounted to the body. The styling section includes a plurality of tines extending in the direction. The tines of the styling section initially not extend through the hair of the user when the body is worn on the hair of the user. The body is movable relative to the hair of the user so that the tines of the styling section extend through another portion of the hair not enveloped by the enveloping section to position the body on the hair of the user.

In preferred forms, each tine includes a protrusion on each of two sides thereof. Each protrusion is adapted for clamping the hair of the user when the hair ornament is worn on the hair of the user.

In a preferred form, the body includes left and right clamping portions each having first and second ends. The first end of each of the left and right clamping portions includes a plurality of teeth. The second ends of the left and right clamping portions are pivotably connected together. A spring biases the left and right clamping portions so that the left and right clamping portions are movable between an open position and a closed position. The enveloping section is formed between the left and right clamping portions. The lower end of the enveloping section is aligned with an outermost tooth of the right clamping portion. Each tine extends from a bottom section of the outermost tooth of the right clamping portion in the direction. The left clamping portion is located at a left side of the portion of the hair of the user enveloped by the enveloping section when the hair ornament is worn on the hair of the user. The right clamping portion is located at a right side of the portion of the hair of the user enveloped by the enveloping section when the hair ornament is worn on the hair of the user.

In another preferred form, the body includes inner and outer clamping portions each having first and second ends. The first end of each of the inner and outer clamping portions includes a plurality of teeth. The second ends of the inner and outer clamping portions are pivotably connected together. A spring biases the inner and outer clamping portions so that the inner and outer clamping portions are movable between an open position and a closed position. The enveloping section is formed between the inner and outer clamping portions. The lower end of the enveloping section is aligned with the outermost tooth of the outer clamping portion. Each tine extends from a bottom section of the outermost tooth of the inner clamping portion in the direction. The inner clamping portion is located at an inner side of the portion of the hair of the user enveloped by the enveloping section when the hair ornament is worn on the hair of the user. The outer clamping portion is located at an outer side of the portion of the hair of the user enveloped by the enveloping section when the hair ornament is worn on the hair of the user.

In a further preferred form, the body includes inner and outer clamping portions pivotably connected at first ends thereof. A spring biases the inner and outer clamping portions so that the inner and outer clamping portions are movable between an open position and a closed position. The enveloping section is formed between the inner and outer clamping portions. Each tine extends from the outer clamping portion in the direction. The inner clamping portion is located at an inner side of the portion of the hair of the user enveloped by the enveloping section when the hair ornament is worn on the hair of the user. The outer clamping portion is located at an outer side of the portion of the hair of the user enveloped by the enveloping section when the hair ornament is worn on the hair of the user.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
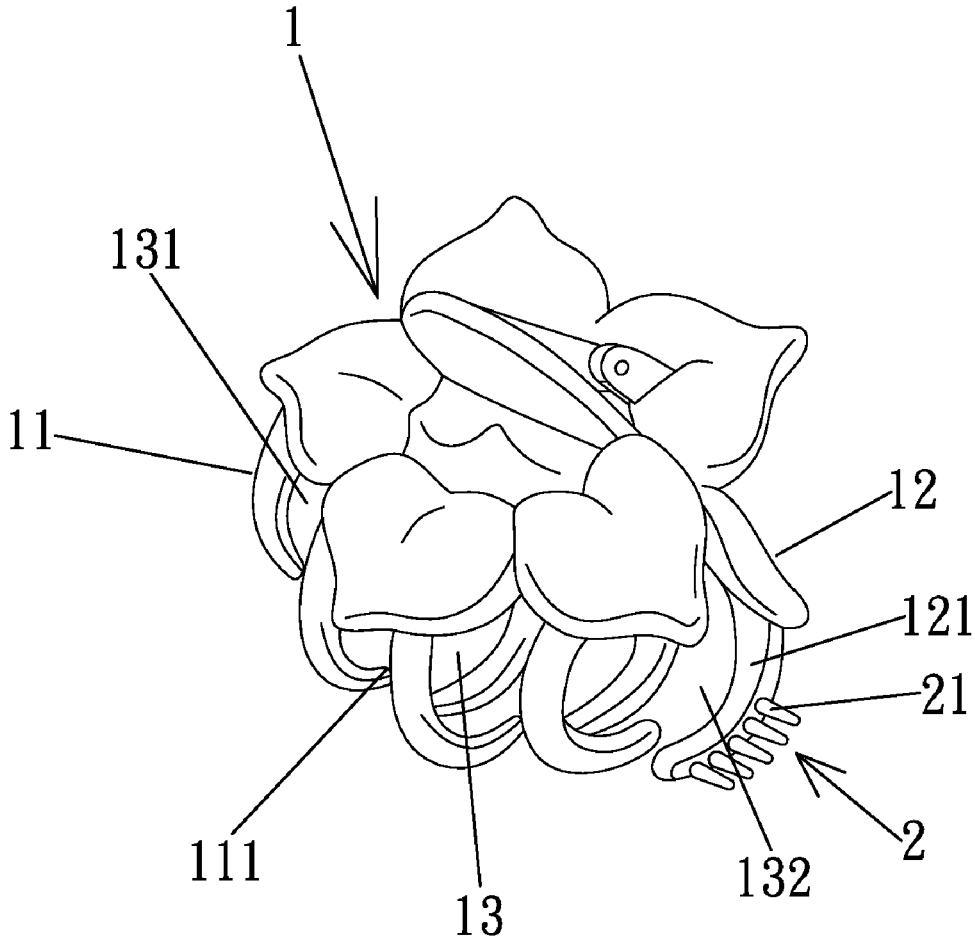
FIG. 1 shows a perspective view of a hair ornament of a first embodiment according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

A hair ornament of a first embodiment according to the preferred teachings of the present invention is shown in FIGS. 1-6 and generally includes a body 1 and a styling section 2. The body 1 includes left and right clamping portions 11 and 12 each having first and second ends. A plurality of teeth 111, 121 is formed on the first end of each of the left and right clamping portions 11 and 12. The second ends of the left and right clamping portions 11 and 12 are pivotably connected together so that the left and right clamping portions 11 and 12 can pivot about a pivot axis extending in a direction. A spring is provided to bias the left and right clamping portions 11 and 12 so that the left and right clamping portions 11 and 12 can move between an open position and an engaged position. The left and right clamping portions 11 and 12 are normally in the engaged position, and the teeth 111 of the left clamping portion 11 engage with the teeth 121 of the right clamping portion 12 with each tooth 111 located between two adjacent teeth 121. An enveloping section 13 is formed between the left and right clamping portions 11 and 12 and extends in the direction. The enveloping section 13 includes upper and lower ends 131 and 132 spaced in the direction. The lower end 132 of the enveloping section 13 is aligned with an outermost tooth 121 of the right clamping portion 12. The styling section 2 includes a plurality of tines 21 extending in the direction and parallel to and spaced from the pivot axis. Each tine 21 is integrally formed on a bottom section of the outermost tooth 121 of the clamping portion 12 and extends in the direction. Namely, the styling section 2 is integrally formed with the body 1 as a single continuous monolithic member.

Figure 2:
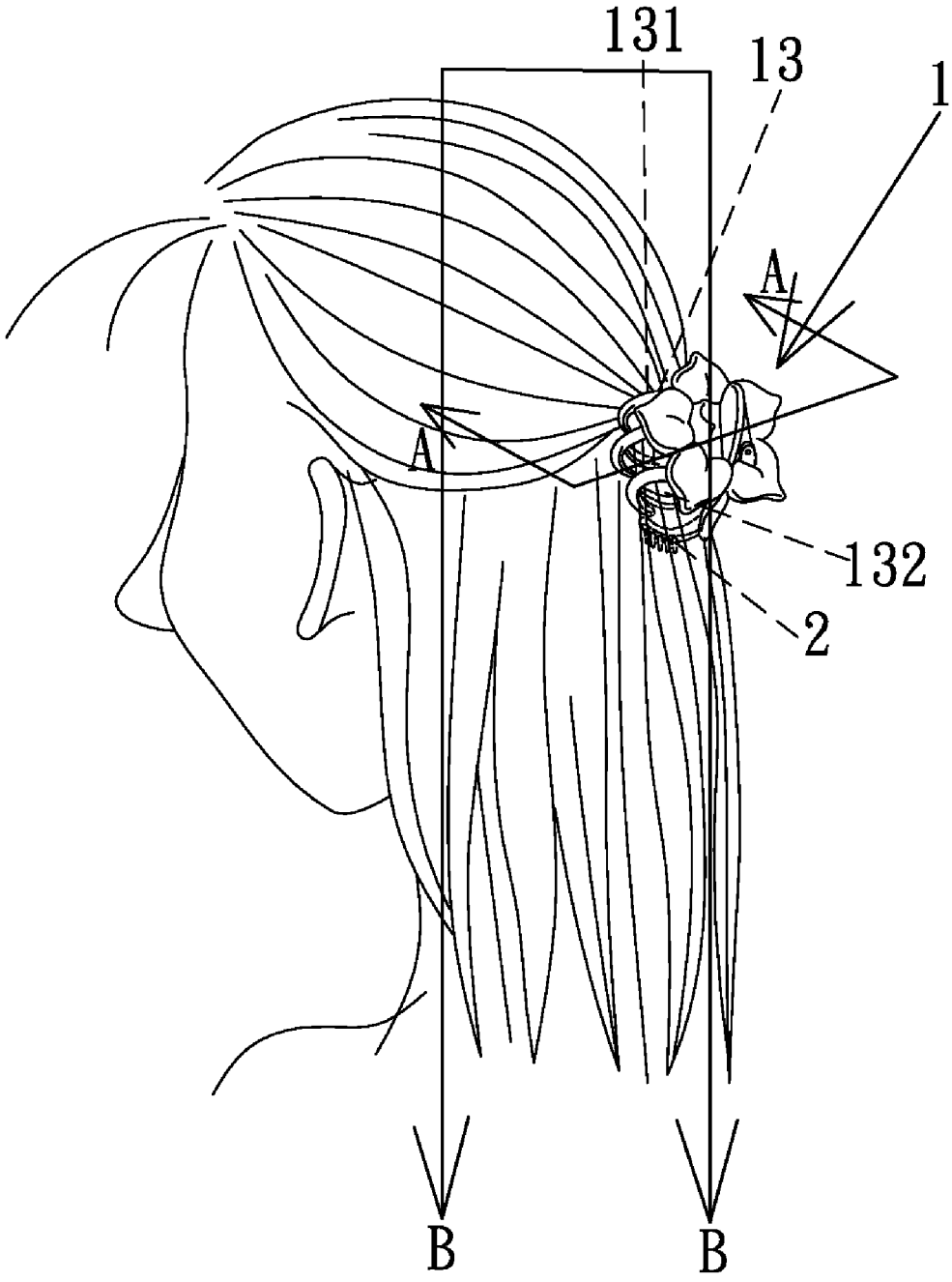
FIG. 2 shows a perspective view illustrating use of the hair ornament of FIG. 1 on hair of a user with the hair ornament in an initial position.
Figure 3:
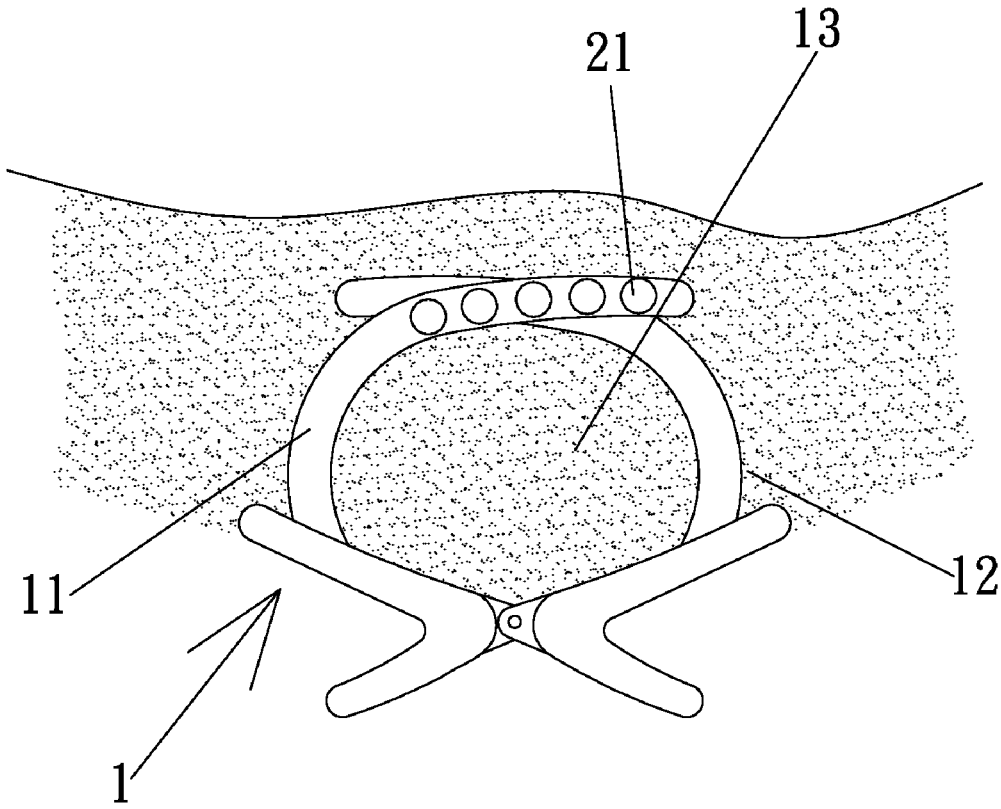
FIG. 3 shows a cross sectional view taken along section line A-A of FIG. 2.
Figure 4:
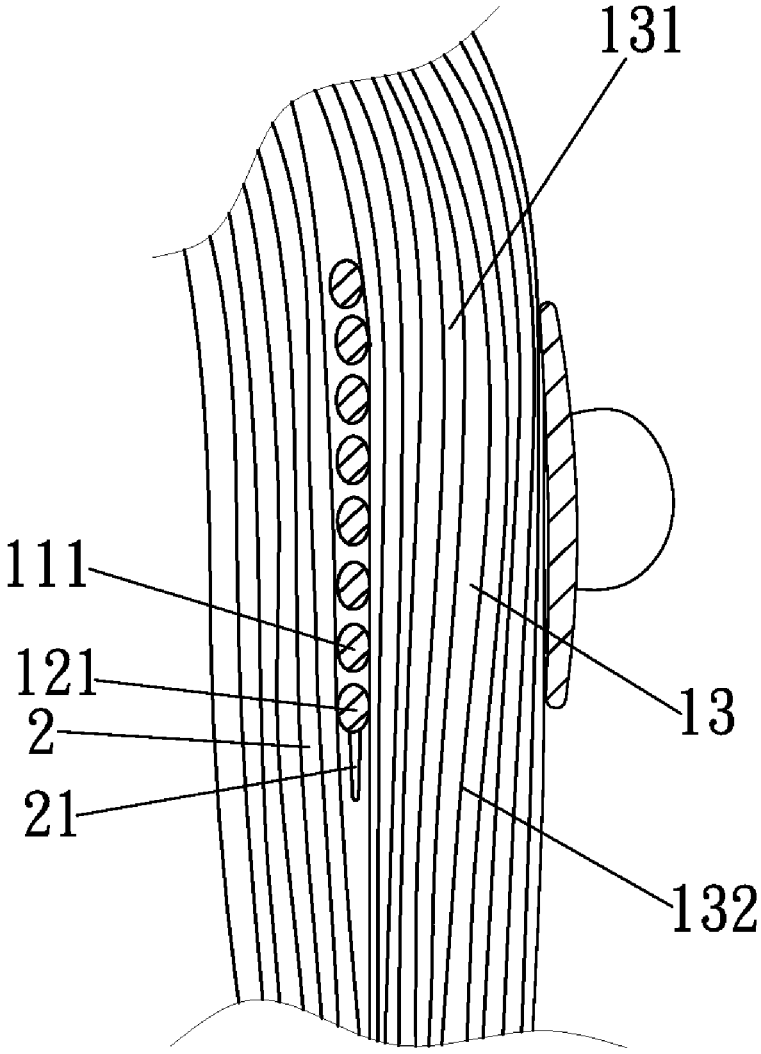
FIG. 4 shows a cross sectional view taken along section line B-B of FIG. 2.
Figure 5:
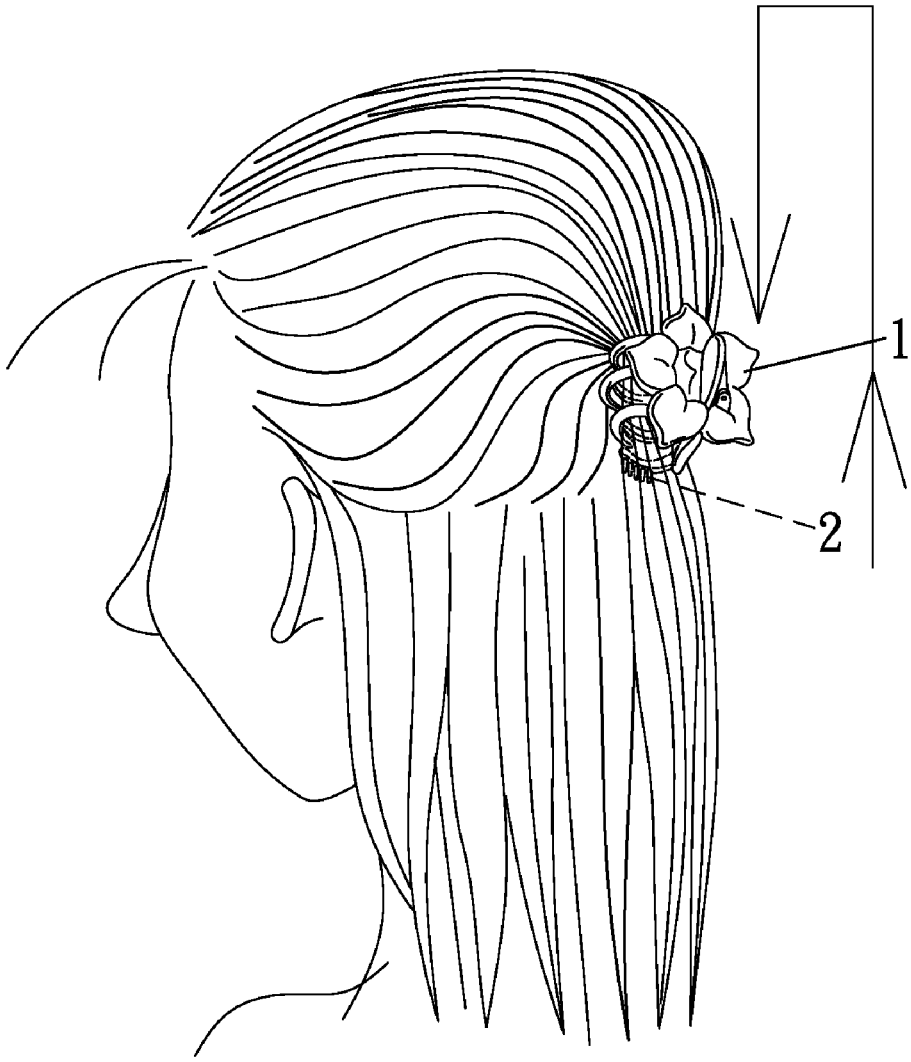
FIG. 5 shows a perspective view illustrating use of the hair ornament of FIG. 1 on the hair of the user with the hair ornament in its final position.
Figure 6:
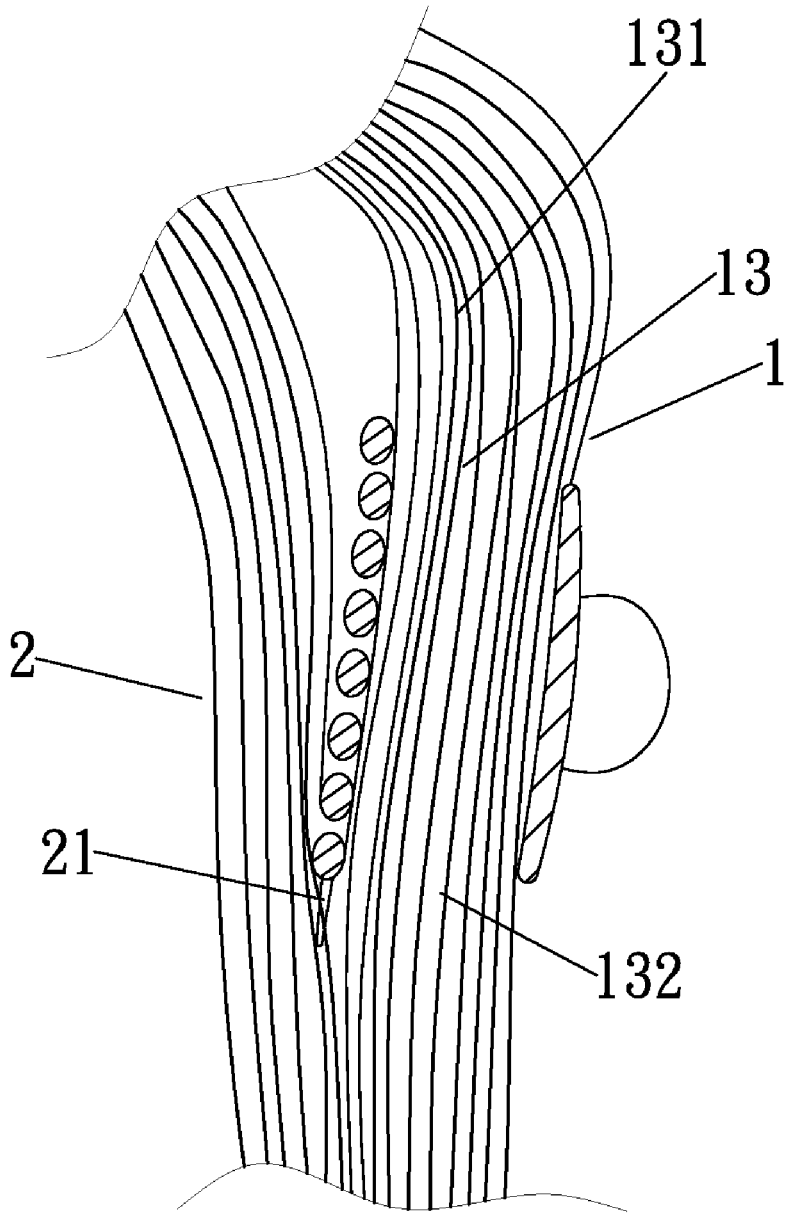
FIG. 6 shows a cross sectional view of the hair and the hair ornament of FIG. 5.

In use, the hair ornament is placed on hair of a user with the left and right clamping portions 11 and 12 engaged with each other, with a portion of the hair of the user extending through and enveloped by the upper and lower ends 131 and 132 of the enveloping section 13, and with the tine 21 not extending through the portion of the hair enveloped by the enveloping section 13 (FIGS. 2-4). Note that the left clamping portion 11 is at a left side of the portion of the hair enveloped by the enveloping section 13, and the right clamping portion 12 is at a right side of the portion of the hair enveloped by the enveloping section 13. The body 1 of the hair ornament is then moved upward, so that the tines 21 of the styling section 2 extend through another portion of the hair not enveloped by the enveloping section 13. Thus, the body 1 is positioned, and a bulge is formed above the portion of the hair enveloped by the enveloping section 13. A bulging effect of hair is, thus, provided at a rear of the head of the user (FIGS. 5 and 6). As a result, a beautiful hairstyle can be provided at the rear of the head, even though the rear of the head of the user is flat.

Figure 7:
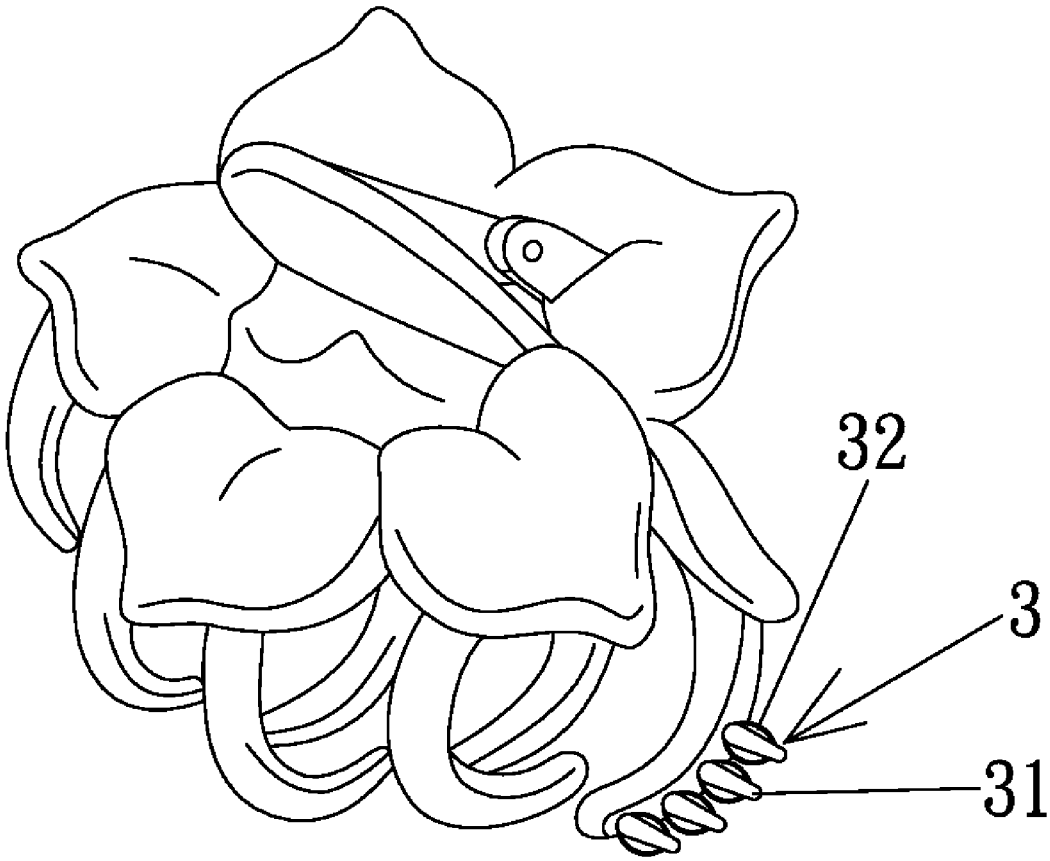
FIG. 7 shows a perspective view of a hair ornament of a second embodiment according to the preferred teachings of the present invention.

FIG. 7 shows a hair ornament of a second embodiment according to the preferred teachings of the present invention modified from the first embodiment, wherein each tine 31 of the styling section 3 has a protrusion 32 on each of two sides of the tine 31. The protrusions 32 clamp the hair of the user to provide a more stable clamping effect by extending through the hair of the user.

Figure 8:
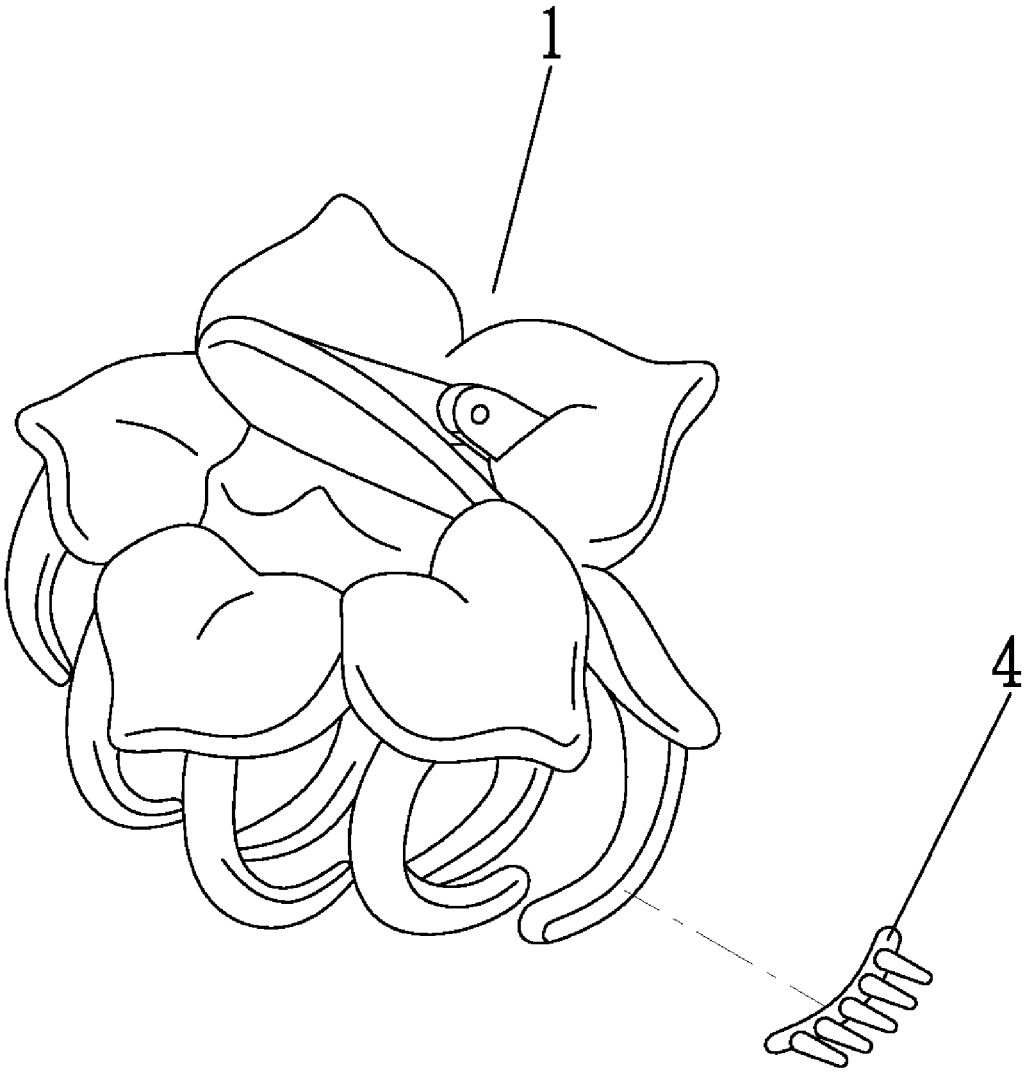
FIG. 8 shows an exploded, perspective view of a hair ornament of a third embodiment according to the preferred teachings of the present invention.

FIG. 8 shows a hair ornament of a third embodiment according to the preferred teachings of the present invention modified from the first embodiment, wherein the styling section 4 is separate from the body 1 and is engaged with the body 1 by bonding or other suitable provisions such as by a connecting member.

Figure 9:
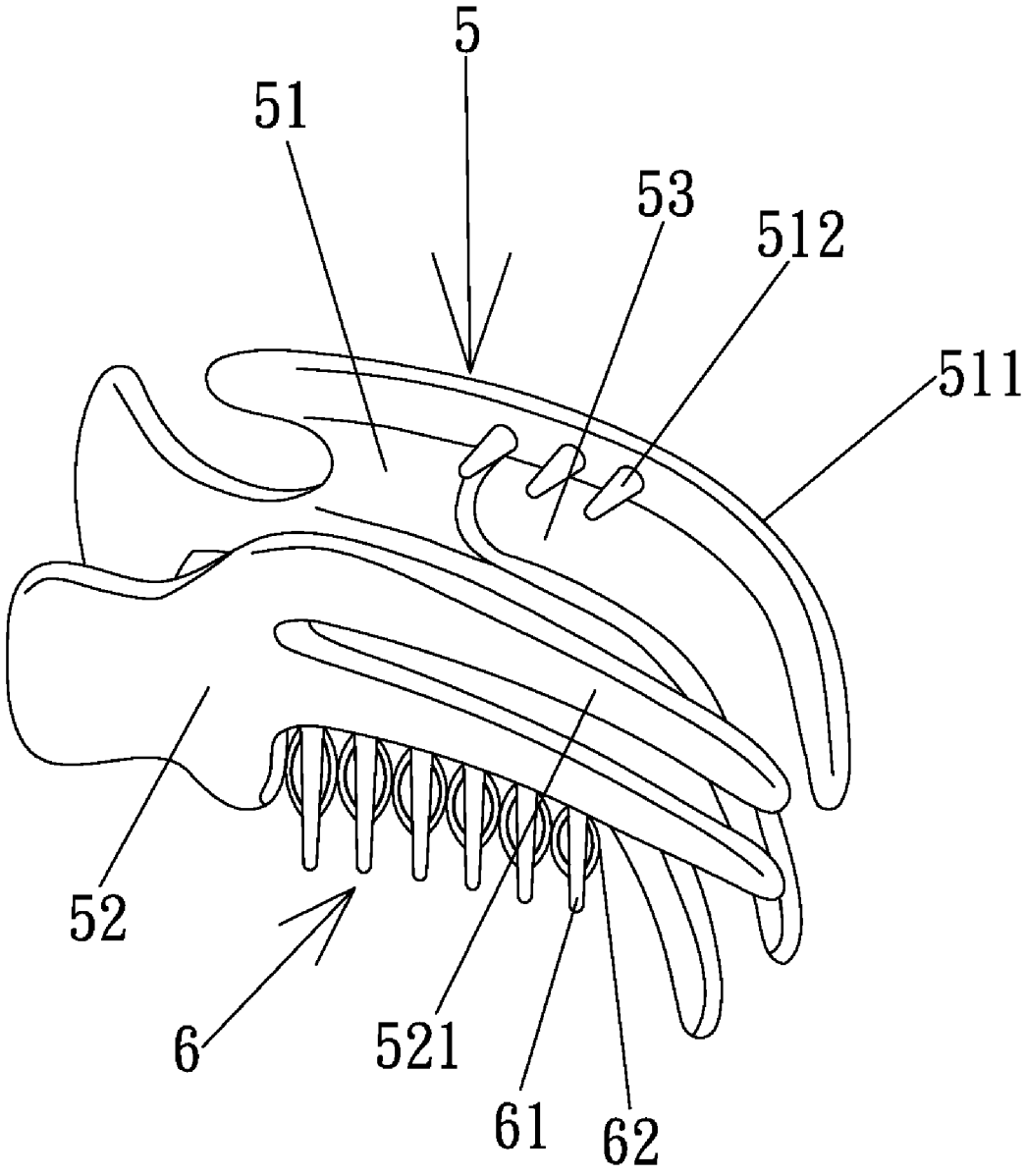
FIG. 9 shows a perspective view of a hair ornament of a fourth embodiment according to the preferred teachings of the present invention.
Figure 10:
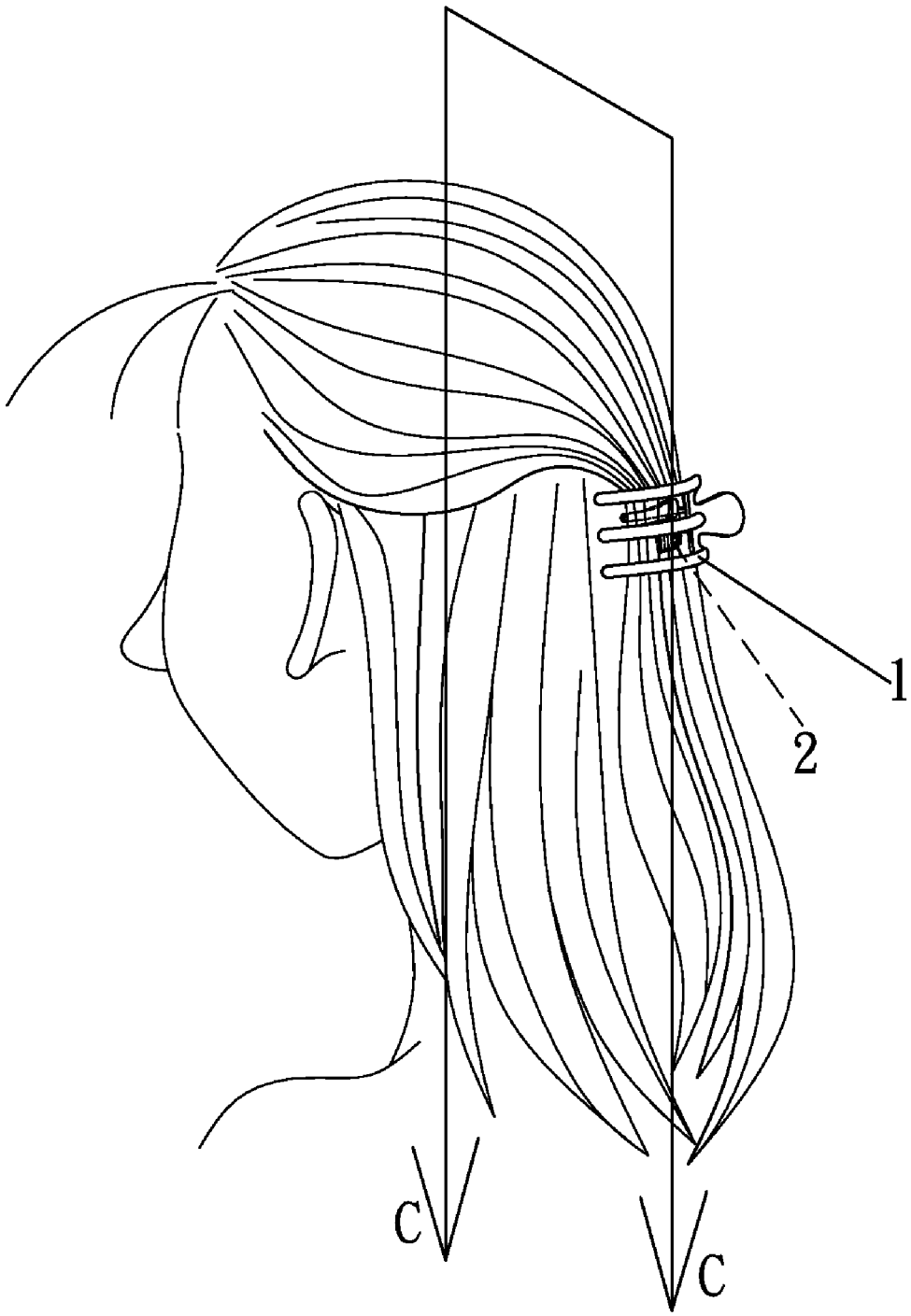
FIG. 10 shows a perspective view illustrating use of the hair ornament of FIG. 9 on hair of a user with the hair ornament in an initial position.
Figure 11:
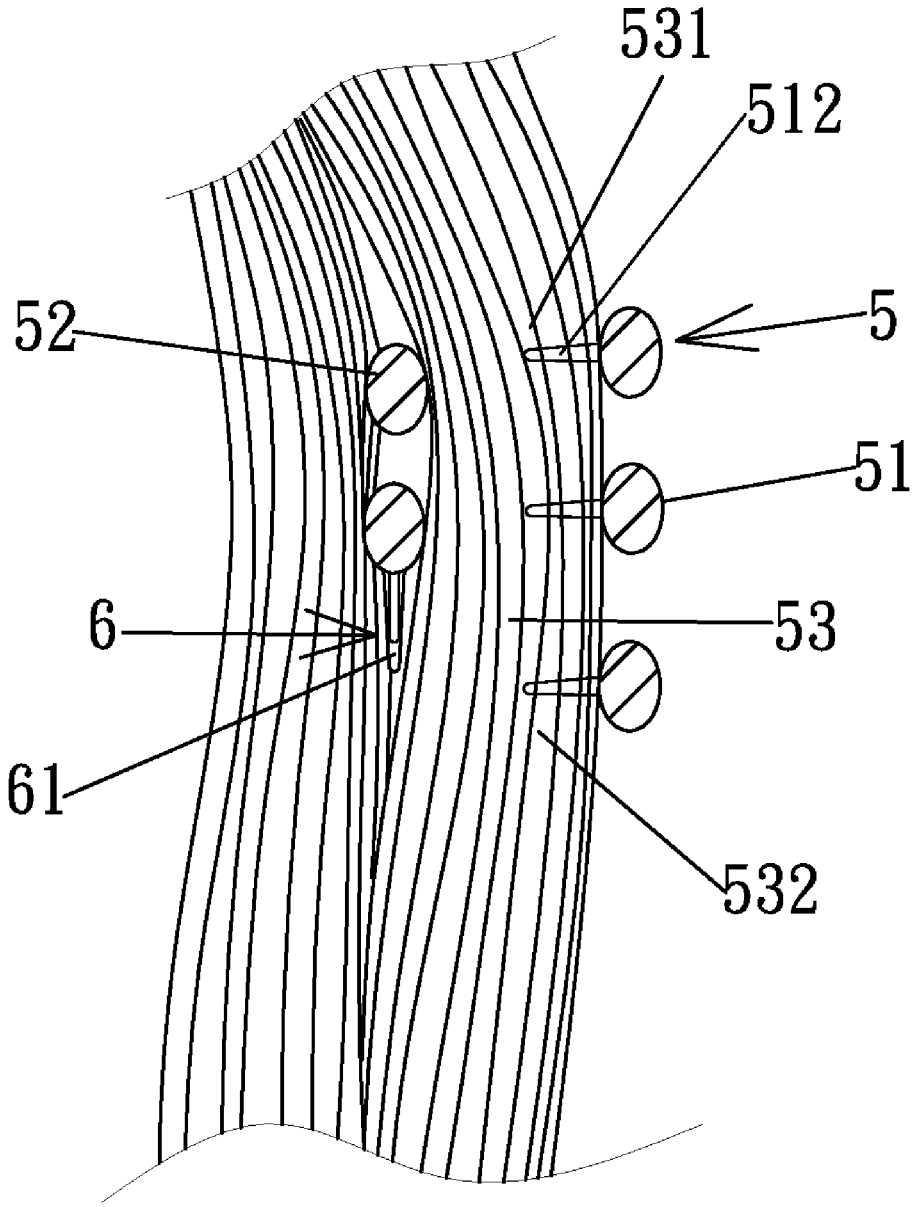
FIG. 11 shows a cross sectional view taken along section line C-C of FIG. 10.

FIGS. 9-11 show a hair ornament of a fourth embodiment according to the preferred teachings of the present invention modified from the first embodiment. Specifically, in this embodiment, the hair ornament includes a body 5 and a styling section 6. The body 5 includes inner and outer clamping portions 51 and 52 each having first and second ends. A plurality of teeth 511, 521 are formed on the first end of each of the outer and inner clamping portions 51 and 52. The second ends of the outer and inner clamping portions 51 and 52 are pivotably connected together so that the outer and inner clamping portions 51 and 52 can pivot about a pivot axis extending in a first direction. A spring is provided to bias the outer and inner clamping portions 51 and 52 so that the clamping portions can move between an open position and an engaged position. The outer and inner clamping portions 51 and 52 are normally in the engaged position, and the teeth 511 of the outer clamping portion 51 normally engage with the teeth 521 of the inner clamping portion 52 with each tooth 511 located between two adjacent teeth 521. The outer clamping portion 51 further includes a plurality of tines 512 extending from an inner face thereof in the first direction. An enveloping section 53 is formed between the outer and inner clamping portions 51 and 52. The enveloping section 53 includes upper and lower ends 531 and 532 spaced in a second direction perpendicular to the first direction. The lower end 532 of the enveloping section 53 is aligned with an outermost tooth 521 of the inner clamping portion 52. The styling section 6 includes a plurality of tines 61 formed on a bottom section of an outermost tooth 521 of the inner clamping portion 52. Each tine 61 extends away from the enveloping section 53 in the second direction. Each tine 61 includes a protrusion 62 on each of two sides thereof.

Figure 12:
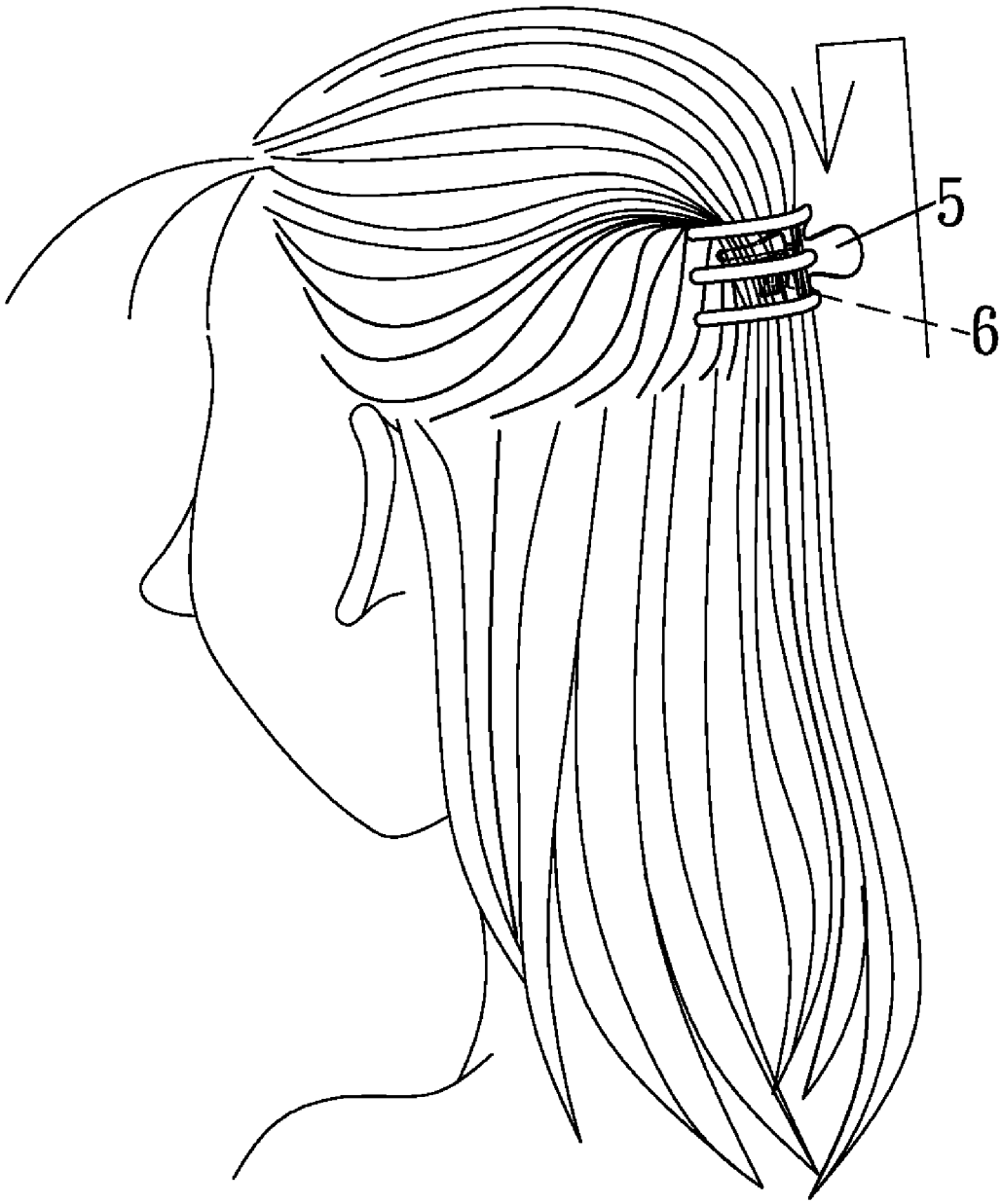
FIG. 12 shows a perspective view illustrating use of the hair ornament of FIG. 9 with the hair ornament in its final position.
Figure 13:
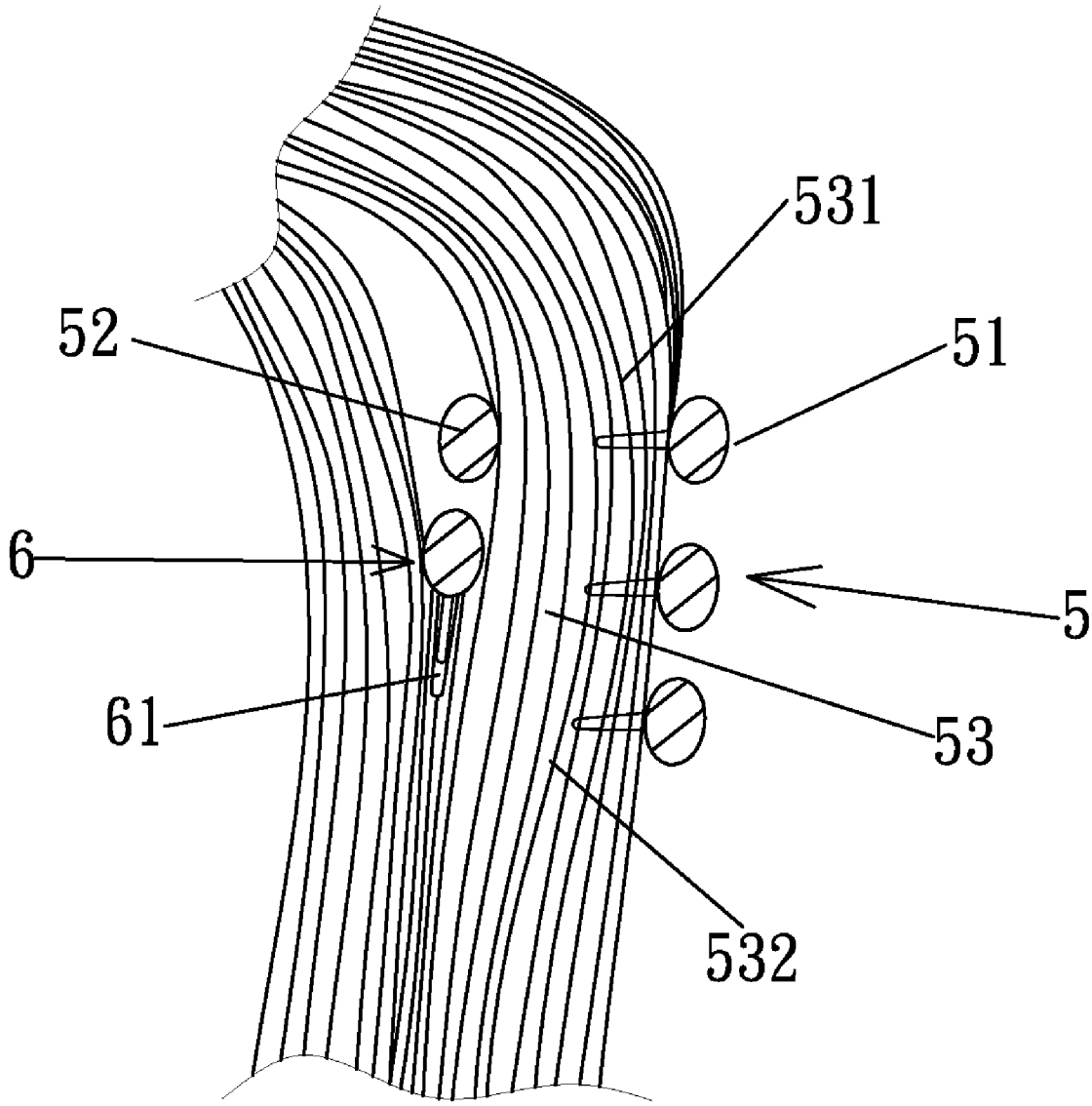
FIG. 13 shows a cross sectional view of the hair of the hair ornament of FIG. 12.

In use, the hair ornament is placed on hair of a user with the outer and inner clamping portions 51 and 52 engaged with each other, with a portion of the hair of the user extending through and enveloped by the enveloping section 53, and with the tines 61 not extending through the portion of the hair enveloped by the enveloping section 53 (FIGS. 10 and 11). Note that the inner clamping portion 52 is at an inner side of the portion of the hair enveloped by the enveloping section 53, and the outer clamping portion 51 is at an outer side of the portion of the hair enveloped by the enveloping section 53. The body 5 of the hair ornament is then moved upward, so that the tines 61 of the styling section 6 extend through another portion of the hair not enveloped by the enveloping section 53. Thus, the body 5 is positioned, and a bulge is formed above the portion of the hair enveloped by the enveloping section 53. A bulging effect of hair is, thus, provided at a rear of the head of the user (FIGS. 12 and 13). As a result, a beautiful hairstyle can be provided at the rear of the head, even though the rear of the head of the user is flat.

Figure 14:
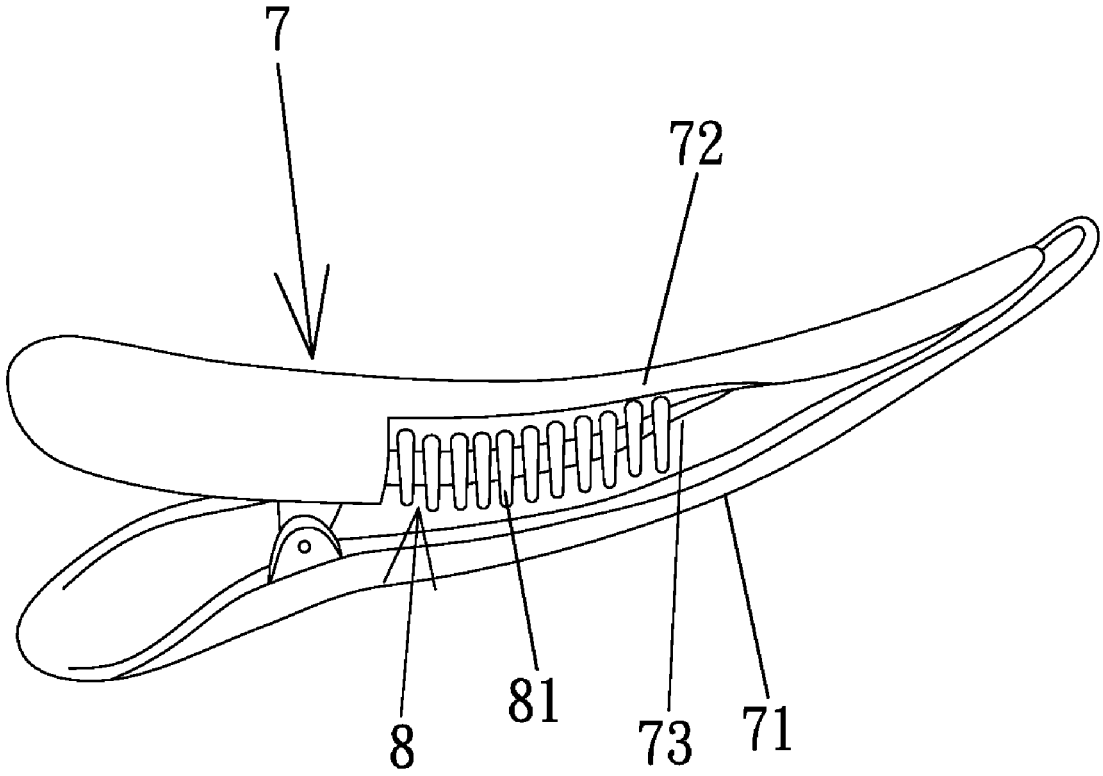
FIG. 14 shows a perspective view of a hair ornament of a fifth embodiment according to the preferred teachings of the present invention.
Figure 15:
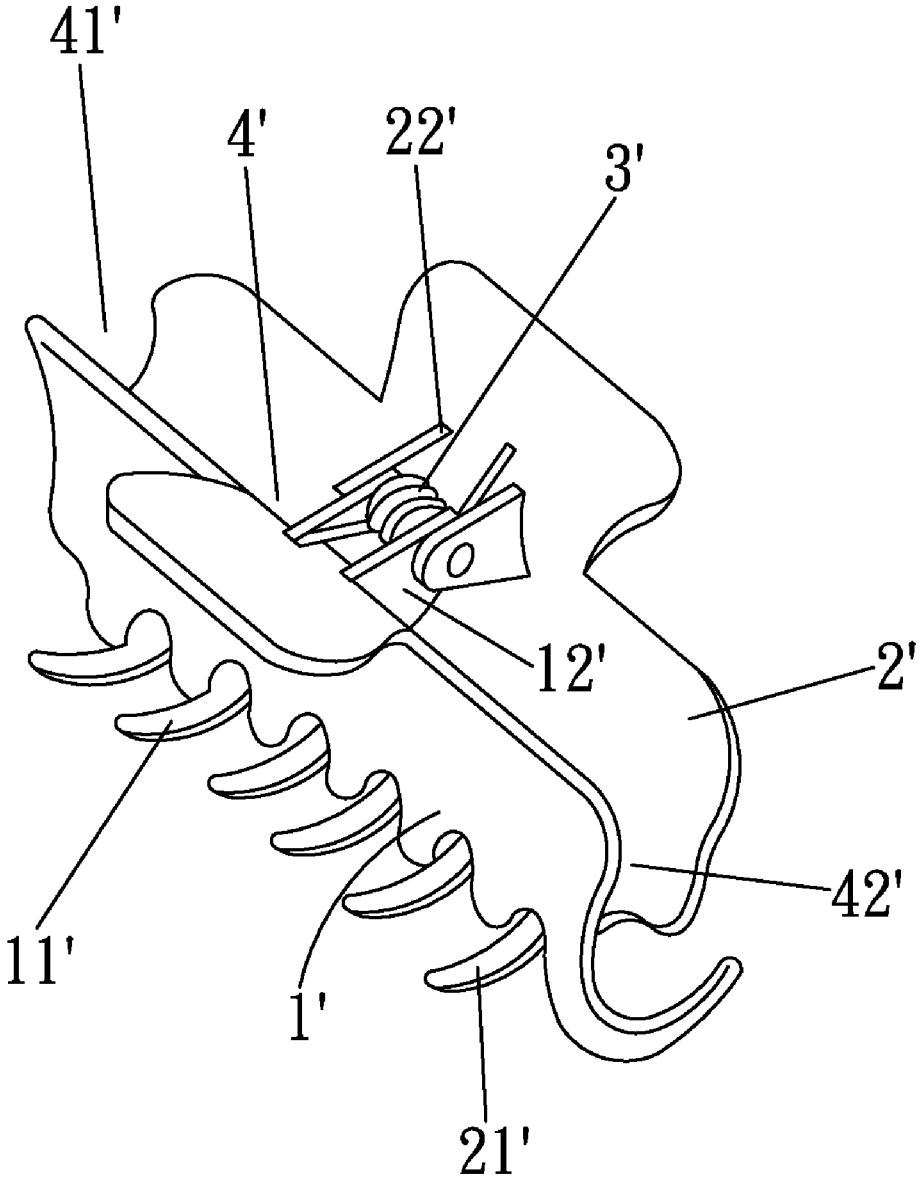
F I G . 15 Prior Art
FIG. 15 shows a perspective view of a conventional hair ornament.
Figure 16:
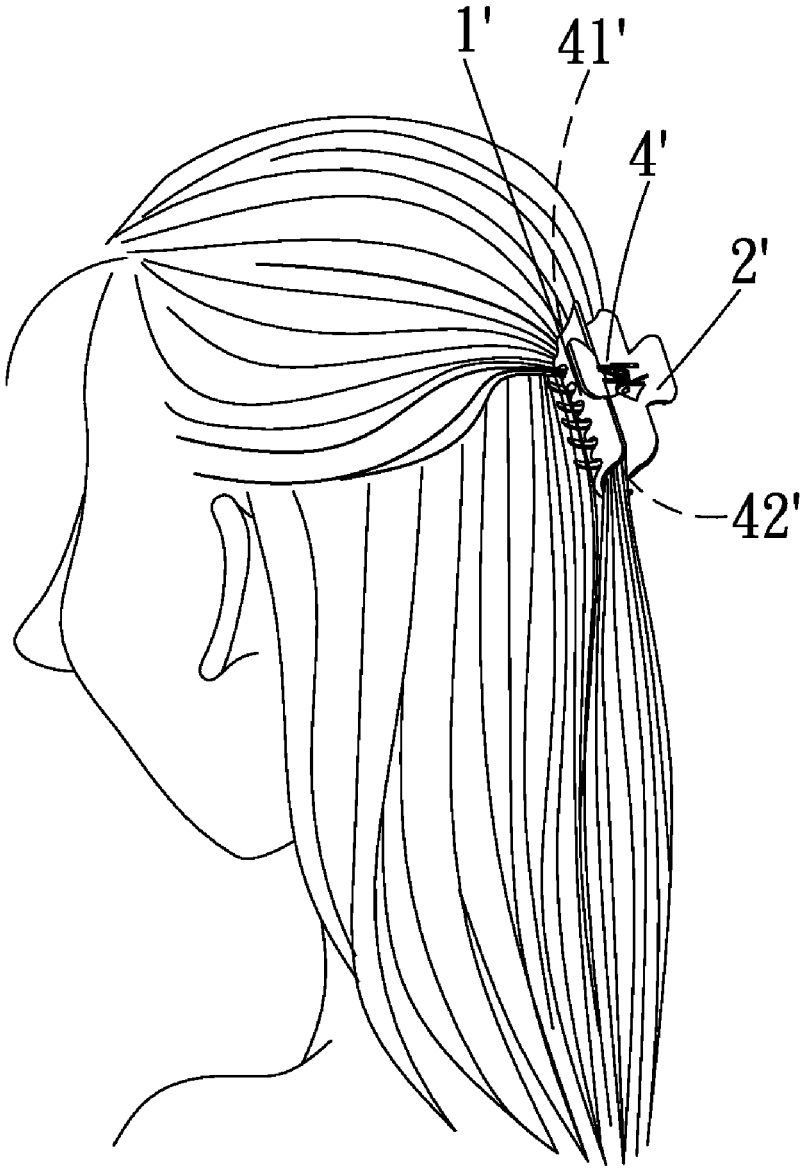
F I G . 16 Prior Art
FIG. 16 shows a perspective view illustrating use of the hair ornament of FIG. 15 on hair of a user.

FIG. 14 shows a hair ornament of a fifth embodiment according to the preferred teachings of the present invention modified from the fourth embodiment, wherein the body 7 includes inner and outer clamping portions 71 and 72 pivotably connected at first ends thereof and moveable between an open position and a closed position under action of a spring. An enveloping section 73 is formed between the inner and outer clamping portions 71 and 72. The enveloping section 73 includes upper and lower ends spaced in a direction perpendicular to the pivot axis of the inner and outer clamping portions 71 and 72. The styling section 8 includes a plurality of tines 81 extending from the clamping portion 72 in the direction perpendicular to the pivot axis.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hair ornament comprising: a body including an enveloping section adapted for enveloping a portion of hair of a user, with the enveloping section including an upper and a lower end spaced at a higher and a lower position, respectively, in a direction X, with the portion of the hair of the user extending through the upper and lower end of the enveloping section; and a styling section mounted to the body, with the styling section including a plurality of tines extending and positioning in hair beneath the portion of hair enveloped by the enveloping section, with the body including inner and outer clamping portions each having a first and second end, with the first end of each of the inner and outer clamping portions including a plurality of teeth, with the second end of the inner and outer clamping portions being pivotably connected together, with a spring biasing the inner and outer clamping portions so that the inner and outer clamping portions are movable between an open position and a closed position, with the enveloping section formed between the inner and outer clamping portions, with the lower end of the enveloping section aligned with an outermost one of the plurality of teeth of the outer clamping portion, with each of the plurality of tines extending from a bottom section of the outermost one of the plurality of teeth of the inner clamping portion in the direction, X with the inner clamping portion adapted to be located at an inner side of the portion of the hair of the user enveloped by the enveloping section when the hair ornament is worn on the hair of the user, and with the outer clamping portion adapted to be located at an outer side of the portion of the hair of the user enveloped by the enveloping section when the hair ornament is worn on the hair of the user.

* * * * *